US005387300A

United States Patent [19]

Kitamura

[11] Patent Number: 5,387,300

[45] Date of Patent: Feb. 7, 1995

[54] METHOD OF MANUFACTURING A SEAMLESS TUBULAR WOVEN ARTICLE INCLUDING POLYTETRAFLUOROETHYLENE YARN

[76] Inventor: Atsushi Kitamura, 30, Izumi-Hommachi 5-chome, Kanazawa-shi, Ishikawa 921, Japan

[21] Appl. No.: 39,444

[22] PCT Filed: Aug. 27, 1992

[86] PCT No.: PCT/JP92/01091

§ 371 Date: Apr. 30, 1993

§ 102(e) Date: Apr. 30, 1993

[87] PCT Pub. No.: WO93/05218

PCT Pub. Date: Mar. 18, 1993

[30] Foreign Application Priority Data

Sep. 4, 1991 [JP] Japan ..... 3-254633

[51] Int. Cl.[6] ..... B29C 67/04; B29D 31/00; B03D 3/02; B03D 15/00

[52] U.S. Cl. ..... 156/148; 139/387 R; 139/388; 139/420 A; 156/308.2; 264/103; 264/127; 264/147

[58] Field of Search ..... 264/103, 127, 146–147, 264/126; 139/420 R, 420 A, 387 R, 388; 156/48, 155, 149, 308.2

[56] References Cited

U.S. PATENT DOCUMENTS

| | | | |
|---|---|---|---|
| 2,804,886 | 9/1957 | White | 139/420 R |
| 2,906,573 | 9/1959 | Runton | 139/387 R |
| 2,941,911 | 6/1960 | Kumnick et al. | 264/127 X |
| 3,095,017 | 6/1963 | Bleiler et al. | 139/387 R |
| 3,096,560 | 7/1963 | Liebig | 139/387 R |
| 3,105,492 | 10/1963 | Jeckel | 139/387 R |
| 3,304,557 | 2/1967 | Polansky | 139/387 R |
| 3,315,020 | 4/1967 | Gore | 264/127 X |
| 3,316,557 | 5/1967 | Liebig | 139/387 R |
| 3,432,587 | 3/1969 | Shinn et al. | 264/127 X |
| 3,765,978 | 10/1973 | Matt | 156/148 |
| 3,804,479 | 4/1974 | Butzow et al. | 139/420 R X |
| 3,953,566 | 4/1976 | Gore | 264/127 X |
| 4,174,739 | 11/1979 | Rasero et al. | 139/388 |
| 4,530,113 | 7/1985 | Matterson | 139/387 R X |
| 5,262,234 | 11/1993 | Minor et al. | 264/127 X |

FOREIGN PATENT DOCUMENTS

| | | | |
|---|---|---|---|
| 53-19457 | 2/1978 | Japan . | |
| 55-22031 | 2/1980 | Japan . | |
| 55-71185 | 5/1980 | Japan . | |
| 62-62949 | 3/1987 | Japan . | |
| 1-92445 | 4/1989 | Japan . | |
| 2-61131 | 1/1990 | Japan . | |
| 2182940 | 7/1990 | Japan | 139/387 R |
| 219139 | 7/1924 | United Kingdom | 139/420 R |

OTHER PUBLICATIONS

"Progress in Synthetic Graft Development–An Improved Crimped Graft of Teflon", *Surgery*, vol. US., No. 2, Feb. 1959, pp. 298–309.

"USCI Prosthesis for Surgery", Jul. 1974, pp. 1–20.

*Primary Examiner*—Adrienne Johnstone

*Attorney, Agent, or Firm*—Armstrong, Westerman, Hattori, McLeland & Naughton

[57] ABSTRACT

Using an unsintered or sintered polytetrafluoroethylene yarn as at least part of warp and/or filling, a seamless tubular fabric is constructed. This construction is made by circular weaving or by inserting the filling into the warp prepared in the form of a hank or skein.

1 Claim, 1 Drawing Sheet

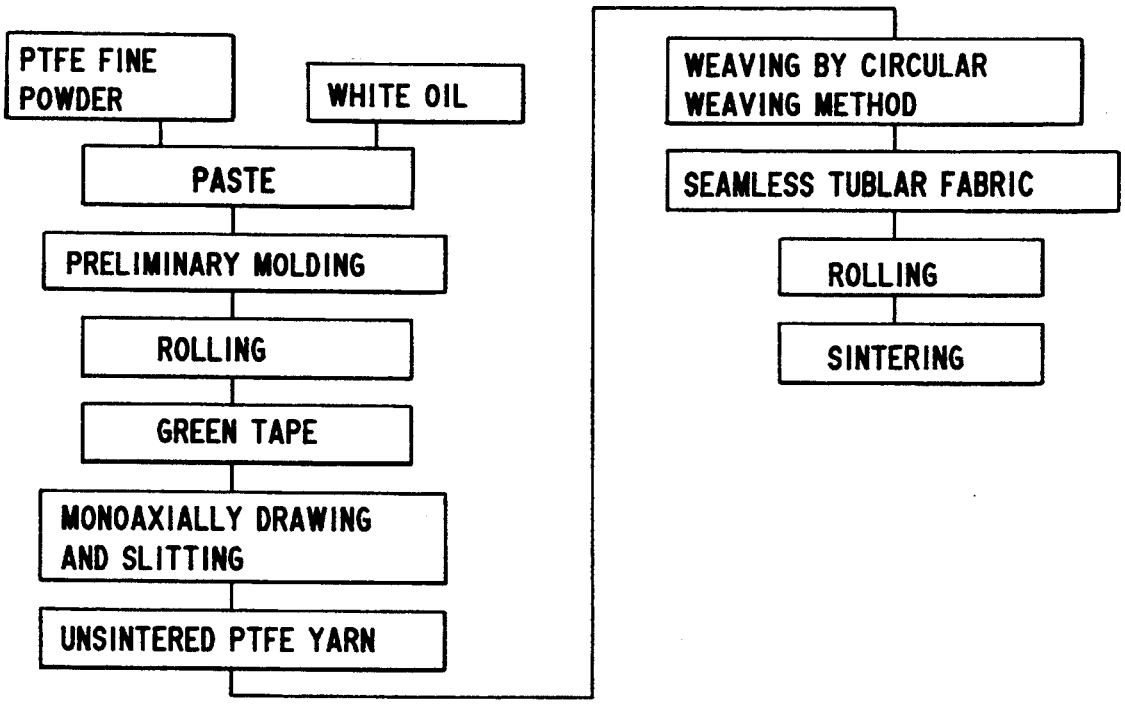
PTFE FINE POWDER
WHITE OIL
PASTE
PRELIMINARY MOLDING
ROLLING
GREEN TAPE
MONOAXIALLY DRAWING AND SLITTING
UNSINTERED PTFE YARN
WEAVING BY CIRCULAR WEAVING METHOD
SEAMLESS TUBLAR FABRIC
ROLLING
SINTERING

METHOD OF MANUFACTURING A SEAMLESS TUBULAR WOVEN ARTICLE INCLUDING POLYTETRAFLUOROETHYLENE YARN

TECHNICAL FIELD

The present invention relates to a method of manufacturing a seamless tubular article which comprises weaving a seamless tubular fabric using a polytetrafluoroethylene yarn.

BACKGROUND ART

Prior Art

Seamless tubular fabrics

By assembling a warp yarn and a filling yarn in the manner of a circular or hollow wave, a radially seamless tubular fabric can be manufactured. The chief material of such warp and filling yarns is a polyester or a nylon. This seamless tubular fabric can be sliced at appropriate widths in the radial direction to provide loop-like seamless belts. The seamless belts thus obtained find application as conveyor belts, transmission belts, impact printer ink ribbon substrates and so on.

It is also a known technology to impregnate or coat such a seamless tubular fabric (or a loop-shaped seamless belt obtained by slicing it) with a resin and the present applicants also have filed several patent applications, viz.

Japanese Patent Kokai No. 61-40145 discloses a tubular article manufactured by impregnating or coating a hollow fabric woven from warp and filling yarns with a resin. However, fluorine-containing resins are not mentioned as examples of the resin.

Japanese Patent Kokai No. 64-46087 discloses a circular-woven seamless hose formed with bellows and treated with a resin and includes a cursory mention of fluororesins as the resin to be used for such resin treatment.

Raw polytetrafluoroethylene tube

A polytetrafluoroethylene powder having a primary particle diameter of about 0.2 to 0.3 μm and a secondary particle diameter of about 300 to 600 μm which has been separated and granulated from a dispersion prepared by the emulsion polymerization of tetrafluoroethylene is known as fine powder. This fine powder can be easily formed into fiber with a small shear force and absorbs an organic solvent, such as naphtha or white oil, efficiently to give a paste. So, as this paste is extruded to provide a preliminary molding in the shape of a round bar or a sheet which is then compressed by means of rolls to remove the solvent before spontaneous evaporation of the solvent, there is obtained a film known as green tape. The green tape thus obtained has been used commonly as a sealing material for the water pipe and other pipe joints. When sintered, the green tape gives a transparent film.

Polytetrafluoroethylene dispersion processing

A dispersion of polytetrafluoroethylene is an aqueous colloidal suspension containing a nonionic surfactant. As a cloth such as glass cloth, carbon fiber cloth or an aromatic polyamide fiber cloth is repeatedly dipped in this dispersion, dried and sintered, there is obtained an electrical insulation tape or a tape for non-bonding applications.

Problems That the Invention is to Solve

The technologies of impregnating or coating a seamless tubular fabric with a resin as disclosed in JP Kokai No. 61-40145 and JP Kokai No. 64-46087 referred to above comprise a mere disposition of a resin impregnation layer or a resin coating layer in or on the seamless tubular fabric and, therefore, even when an aqueous dispersion of polytetrafluoroethylene is used as the resin, the improvement in surface characteristics is self-limited.

In the polytetrafluoroethylene dispersion treatment of a cloth such as glass cloth or carbon fiber cloth, application of the dispersion in a thick layer gives rise to mad cracks. Therefore, it is imperative to limit the amount of deposition per dose to about 20 μm or less in terms of sintered resin thickness and repeat the dip-dry-sinter cycle 5 to 10 times (usually 7–8 times) to obtain the required thickness. However, such a multi-cycle procedure involves much labor, time and thermal energy with the result that a marked decrease in productivity as well as a cost increase are inevitable.

Under the circumstances, the object of the present invention is to provide a method of manufacturing a seamless tubular article whose texture itself is made up of polytetrafluoroethylene through the employment of polytetrafluoroethylene yarn.

SUMMARY OF THE INVENTION

The method of manufacturing a seamless tubular article according to this invention is characterized in that such a seamless tubular fabric is woven using an unsintered or sintered polytetrafluoroethylene yarn as at least part of warp or/and filling.

BRIEF DESCRIPTION OF THE DRAWING

The drawing illustrates the process steps of the inventive method of manufacturing a seamless tubular article from polytetrafluoroethylene fine powder.

DESCRIPTION OF THE PREFERRED EMBODIMENTS

The unsintered polytetrafluoroethylene yarn is preferably provided by processing a fine powder of polytetrafluoroethylene into a preliminary molding by paste extrusion or calendering and drawing this preliminary molding either as it is or after rolling.

More particularly, the unsintered polytetrafluoroethylene yarn can be prepared as follows. One-hundred parts by weight of a fine powder of polytetrafluoroethylene (a polytetrafluoroethylene powder with a primary particle diameter of about 0.2 to 0.3 μm and a secondary particle diameter of about 300 to 600 μm which has been separated and granulated from a dispersion produced by the emulsion polymerization of tetrafluoroethylene) is caused to absorb 18 to 22 parts by weight of an organic solvent such as naphtha or white oil and the composition is preliminarily molded into a sheet, round bar or wire, which is then rolled by means of rolls as necessary and drawn. The sheet is slit into yarns either before or after drawing.

The sintered polytetrafluoroethylene yarn can be obtained by sintering the unsintered yarn prepared as above at a temperature in the neighborhood of 370° to 400° C. or higher.

Using the above unsintered or sintered yarn as part of warp and/or filling, a seamless tubular fabric is constructed. This weaving is performed by (i) the circular weaving method or (ii) the method which comprises inserting the filling into a hank or skein of the warp. The circular weaving method (i) is a process comprising preparing the warp as face and reverse warps and inserting the filling in two reciprocations in the manner of a loop to serially construct a tubular fabric, with the face and reverse sides being stitched together only at both edges.

The method (ii) comprises arranging the warp in the form of a skein and inserting the filling. Since shedding is difficult at the final stage of weaving, this last stage is finished by hand to complete the weaving operation. In weaving by the above method (i) or (ii), there can be employed

- the mode in which the above-mentioned unsintered or sintered yarn alone is used as both warp and filling.
- the mode in which the above-mentioned unsintered or sintered yarn is used as the filling and an ordinary yarn and said unsintered or sintered yarn are used in combination as the warp,
- the mode in which an ordinary yarn is used as the filling and the above-mentioned unsintered or sintered yarn is used, or the same yarn and an ordinary yarn are used in combination,as the warp, or
- the mode in which the above-mentioned unsintered or sintered yarn and an ordinary yarn are doubled and used as the filling and either the unsintered or sintered yarn or an ordinary yarn is used as the warp.

As the ordinary yarn mentioned above, a variety of yarns can be used but it is particularly preferable to use a yarn made of heat-resistant or high-tenacity fiber such as aramid fiber, carbon fiber, super-high molecular weight polyethylene fiber, polyetherketone fiber, glass fiber and so on.

The weave construction that can be employed includes not only plain weave but also twill weave, satin weave and modifications thereof.

When a seamless tubular fabric constructed using the unsintered yarn still contains a solvent, the fabric is sintered after removal of the solvent. The sintering temperature is about 370° to 400° C. in many instances but a higher temperature can be used to reduce the sintering time.

When the above-mentioned circular weaving method (i) is used, the resulting seamless tubular fabric can be cut in the radial direction at an optional stage, i.e. after weaving, after rolling or after baking, to thereby provide a loop-shaped seamless belt. When the above-mentioned method (ii) is employed, since the selvages have been already formed, cutting is usually not done.

Operation

In accordance with the present invention, the very woven texture of a seamless tubular article is made of polytetrafluoroethylene, instead of being merely treated with a dispersion of polytetrafluoroethylene.

The unsintered yarn of polytetrafluoroethylene containing a solvent shows a rheological behavior like clay on rolling which is carried out after formation of a seamless tubular fabric, with the result that the woven fibers are made integral. Even if a distortion is introduced to the filling in the course of filling using the unsintered yarn, the rolling operation liquidates the distortion. When this fabric is sintered after removal of the solvent, the yarn constituting the fabric is sintered to become transparent and tough.

Since polytetrafluoroethylene is excellent in various properties such as heat resistance,resistance to chemicals, non-adhesiveness, slip performance, wear resistance and electrical insulation, the resulting seamless tubular article has very desirable surface characteristics and is well capable of withstanding rugged conditions of use.

Effect of Invention

Since the seamless tubular article obtained by the method of this invention is such that its very woven texture is made up of polytetrafluoroethylene, it is excellent in various characteristic parameters such as heat resistance, resistance to chemicals, non-adhesiveness, slip performance, wear resistance and electrical insulation property and, therefore, is sufficiently resistant to rugged conditions of use.

In addition, this manufacturing process of the invention for seamless tubular articles is very simple in that sintering, for instance, can be completed in only one session, thus being advantageous in productivity and cost.

Best Mode for Carrying Out the Invention

The following examples are further illustrative of the present invention. In the following description, "parts" are by weight.

EXAMPLE 1

One-hundred parts of a commercial fine powder of polytetrafluoroethylene was caused to absorb 20 parts of white oil to provide a paste, which was then extruded in the form of a sheet. This preliminary molding was rolled with a roll means before evaporation of the solvent to give a green tape.

The green tape was monoaxially drawn and slit at a predetermined width to provide a yarn and using the yarn as warp and filling, a coarse-mesh seamless tubular fabric was constructed by the circular weaving method.

This fabric was set between rolls and rolled, whereby the warp and filling yarns of the fabric were completely integrated. Therefore, it was sliced in the radial direction.

Then, the fabric was dried to remove the white oil by evaporation and sintered in a furnace at 390° C. In this way, a net-like transparent, tough seamless tubular article was obtained.

This seamless tubular article is of use as a seamless belt for conveyance-baking use.

EXAMPLE 2

As in Example 1, the green tape was slit at a predetermined width, monoaxially drawn and, then, twisted to provide a yarn (unsintered yarn).

This unsintered yarn and an aramid multifilament yarn were arranged in alternate arrays to prepare a warp. On the other hand, the above unsintered yarn and the aramid multifilament yarn was doubled in a 1-to-1 manner to prepare a filling. Using these warp and filling, a seamless tubular fabric was constructed by the circular weaving method.

The above fabric was set between press rolls, rolled and dried. Then, it was sintered at 390° C. In this way, a tough seamless tubular article was obtained.

EXAMPLE 3

A carbon fiber yarn was arranged in the form of a skein for use as warp and using a polytetrafluoroethylene yarn (sintered yarn) as filling, twill weaving was carried out to provide a seamless tubular fabric. Since this fabric has preformed selvages, it is already protected against unraveling. Moreover, since it is a twill cloth, the polytetrafluoroethylene yarn is exposed copiously on the surface so that the excellent properties of polytetrafluoroethylene can be effectively exploited.

Industrial Applicability

The seamless tubular article obtainable by the method of the present invention can be used in a variety of applications such as conveyor belts (for food processing, drying, thawing, shrink packing machinery, etc.), transmission belts, conveyance chutes, printing materials, packaging bags, storage bags, binding tube, clothing materials (interliners etc.), biological materials, electrical insulation materials, emergency escape chutes and so on.

I claim:

1. A method of manufacturing a seamless tubular article comprising weaving a seamless tubular fabric, by a circular weaving method, using an unsintered polytetrafluoroethylene yarn at least as part of a warp and/or filling, wherein said unsintered polytetrafluoroethylene yarn is obtained by drawing a preliminary molding, either as such or after rolling, which preliminary molding is obtained by subjecting a fine powder of polytetrafluoroethylene to paste extrusion or calendering, performing a rolling operation on said seamless tubular fabric after weaving, and sintering said seamless tubular fabric after said rolling operation.

* * * * *